US005419617A

United States Patent [19]

Schultz

[11] Patent Number: 5,419,617

[45] Date of Patent: May 30, 1995

[54] DETACHABLE CHAIR ARM

[75] Inventor: Craig H. Schultz, Muscatine, Iowa

[73] Assignee: HON Industries, Inc., Muscatine, Iowa

[21] Appl. No.: 73,717

[22] Filed: Jun. 8, 1993

[51] Int. Cl.[6] ..... A47C 7/54

[52] U.S. Cl. ..... 297/411.27; 297/440.1; 297/DIG. 2; 292/19; 292/80

[58] Field of Search ..... 297/411.2, 411.23, 411.24, 297/411.26, 411.27, 440.1, 440.14, DIG. 2; 292/19, 20, 80

[56] References Cited

U.S. PATENT DOCUMENTS

| | | | |
|---|---|---|---|
| D. 127,281 | 5/1941 | Schreckengost . | |
| D. 261,831 | 11/1981 | Luckey . | |
| D. 279,443 | 7/1985 | Diffrient . | |
| 455,168 | 6/1891 | Case . | |
| 1,890,102 | 12/1932 | Urquhart | 297/411.23 |
| 2,030,635 | 2/1936 | Horwitt et al. . | |
| 2,325,292 | 7/1943 | Westrope . | |
| 2,549,902 | 4/1951 | Hibbard et al. . | |
| 2,760,813 | 8/1956 | Colm . | |
| 2,815,067 | 12/1957 | Richardson . | |
| 3,142,194 | 7/1964 | Garden . | |
| 3,215,470 | 11/1965 | Swenson et al. . | |
| 3,271,073 | 9/1966 | Van Buren, Jr. . | |
| 3,292,972 | 12/1966 | Krueger . | |
| 3,427,054 | 2/1969 | Bergman . | |
| 3,474,993 | 10/1969 | Murcott . | |
| 3,614,156 | 10/1971 | Sarvas . | |
| 3,669,496 | 6/1972 | Chisholm . | |
| 3,669,499 | 6/1972 | Semplonius et al. . | |
| 3,747,976 | 7/1973 | Lacey . | |
| 3,904,242 | 9/1975 | Koepke et al. . | |
| 4,012,158 | 3/1977 | Harper . | |
| 4,036,525 | 7/1977 | Howk . | |
| 4,043,592 | 8/1977 | Fries . | |
| 4,153,296 | 5/1979 | Rhamstine . | |
| 4,221,430 | 9/1980 | Frobose . | |
| 4,267,748 | 5/1981 | Grunewald et al. . | |
| 4,277,102 | 7/1981 | Aaras et al. . | |
| 4,282,634 | 8/1981 | Krauss . | |
| 4,401,006 | 8/1983 | Sekiguchi . | |
| 4,451,084 | 5/1984 | Seeley . | |
| 4,546,668 | 10/1985 | Mattsson . | |
| 4,557,521 | 12/1985 | Lange . | |
| 4,572,578 | 2/1986 | Perkins . | |
| 4,573,737 | 3/1986 | Korn . | |
| 4,616,877 | 10/1986 | Slaats et al. . | |
| 4,647,109 | 3/1987 | Christophersen et al. . | |
| 4,659,135 | 4/1987 | Johnson . | |
| 4,660,885 | 4/1987 | Suhr et al. . | |
| 4,660,887 | 4/1987 | Fleming et al. . | |
| 4,662,681 | 5/1987 | Favaretto . | |
| 4,707,026 | 11/1987 | Johansson . | |
| 4,744,603 | 5/1988 | Knoblock . | |
| 4,828,323 | 5/1989 | Brodersen et al. . | |
| 4,856,846 | 8/1989 | Lohmeyer . | |
| 4,881,424 | 11/1989 | Clark et al. . | |
| 4,892,356 | 1/1990 | Pittman et al. . | |
| 4,908,917 | 3/1990 | Kazle . | |
| 4,917,438 | 4/1990 | Morgan . | |
| 4,961,610 | 10/1990 | Reeder et al. . | |
| 5,007,678 | 4/1991 | DeKraker . | |
| 5,009,467 | 4/1991 | McCoy . | |
| 5,015,038 | 5/1991 | Mrotz, III . | |
| 5,143,422 | 9/1992 | Althofer et al. . | |
| 5,318,347 | 6/1994 | Tseng | 297/411.2 X |

FOREIGN PATENT DOCUMENTS

| | | |
|---|---|---|
| 654651 | 4/1929 | France . |
| 2505158 | 11/1982 | France . |
| 160465 | 12/1979 | Japan . |
| 196030 | 5/1965 | Sweden . |

*Primary Examiner*—Kenneth J. Dorner
*Assistant Examiner*—Milton Nelson, Jr.
*Attorney, Agent, or Firm*—Jones, Day, Reavis & Pogue

[57] ABSTRACT

A chair is provided which comprises a mounting and latch member which is attached to the the chair arm to form a male assembly section and a female member which is attached to bottom of the seat support structure to provide a female section thereon. The female member has a slot for receiving and holding the mounting member and an attached arm so that the chair arm and the seat support structure are firmly and positively affixed to each other in a manner which also readily permits intentional removal. A resilient latch is resiliently and flexibly joined to the member for engaging the female member in order to prevent the male section from being withdrawn from the slot of the female member until the latch is disengaged.

31 Claims, 7 Drawing Sheets

DETACHABLE CHAIR ARM

FIELD OF THE INVENTION

The present invention relates generally to chairs and, more particularly, to chairs having a detachable chair arm.

BACKGROUND OF THE INVENTION

Chairs may have chair arms and arm rests in order to provide increased comfort and to decrease fatigue by providing support for the user's arms and lateral support for the body. In some instances, it may be desirable to remove the chair arm from the chair. However, typical chair arms are attached to the chair using relatively complex mechanisms which require tools to assemble and disassemble, which not only make it difficult for the typical user to selectively remove the chair arm but also increase the assembly and manufacturing costs.

OBJECTS AND SUMMARY OF THE INVENTION

It is an object of the present invention to provide a novel chair construction by which an arm rest may be easily and quickly removed from or attached to a chair without the need for tools.

It is another object of the present invention to provide a latch mechanism for permitting the chair arm to be selectively removed from or attached to the chair which is reliable, simple and easily manufactured.

Another object of the present invention is to provide a symmetrical latch mechanism which may be installed in any orientation.

A further object of the present invention is to provide a removable chair arm which can be adapted to existing chairs.

The present invention is generally directed to a chair arm and latch mechanism which has unique structural features which permit the chair arm to be quickly and easily attached to or removed from the chair without the need for tools. The chair comprises a male member which is attached to either the chair arm or a seat support structure and a female member which can be attached to the other of the chair arm or the seat support structure. The female member has a slot for receiving and holding the male member so that the chair arm and the seat support structure are attached to each other. A latch is resiliently and flexibly attached to the male member or the female member for engaging the other of the male or female member in order to prevent the male member from being withdrawn from the slot of the female member until the latch is intentionally disengaged by the user.

In one embodiment, the chair comprises a mounting and latch member which is attached to the chair arm to form a male assembly section and a female member which is attached to bottom of the seat support structure to provide a female section thereon. The female member has a slot for receiving and holding the mounting member and an attached arm so that the chair arm and the seat support structure are firmly and positively affixed to each other in a manner which also readily permits intentional removal. A resilient latch is resiliently and flexibly joined to the mounting member for engaging the female member in order to prevent the male section from being withdrawn from the slot of the female member until the latch is disengaged. In one exemplary embodiment, the latch is formed by toes projecting at both ends of the mounting member for engaging the female member therebetween and locking the male and female sections together. The trailing toe engages one end of the female section to prevent further insertion of the mounting section. The leading end of the mounting member can be resiliently flexed in order to permit the leading toe to be inserted into the slot and to resiliently engage the female member of the other end of the slot. The mounting member may be symmetrical to permit either end to be inserted into the slot.

These and other features and advantages of the invention will be more readily apparent upon reading the following description of embodiments of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments that fall within the spirit and scope of the invention.

DETAILED DESCRIPTION OF THE PREFERRED EMBODIMENT

Figure 1:
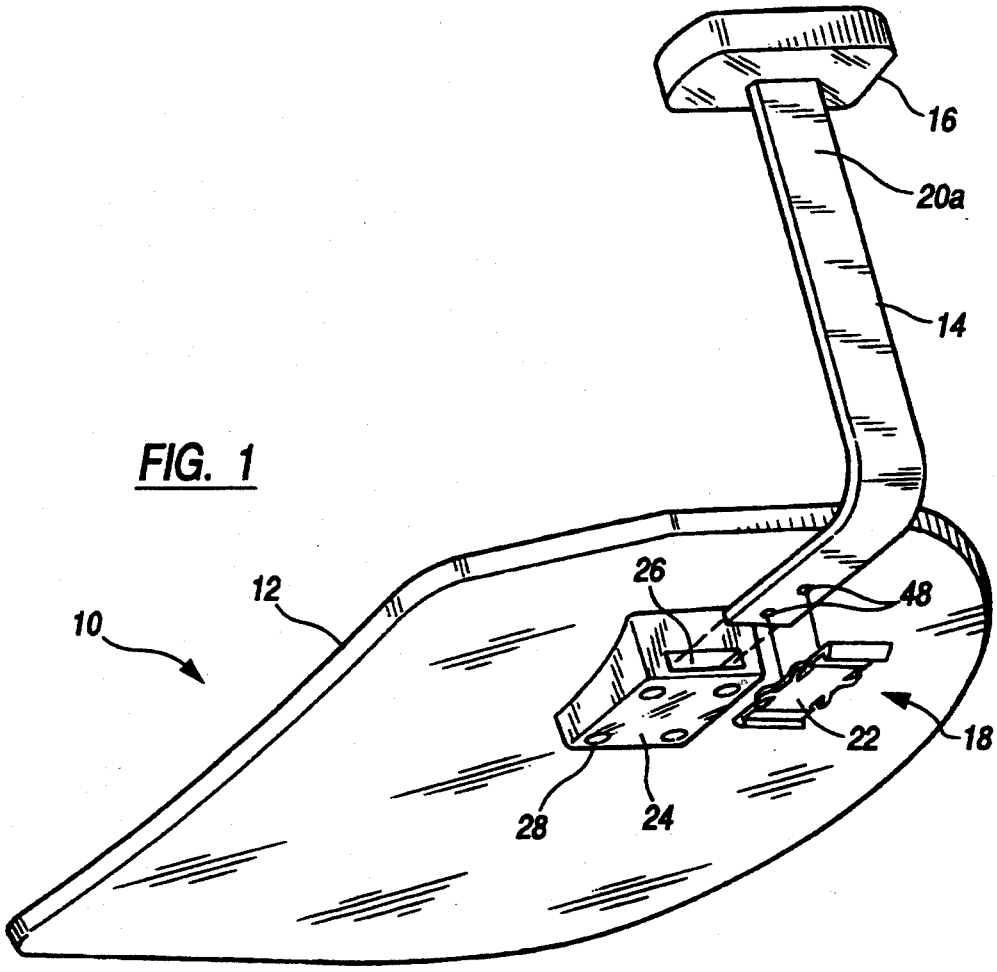
FIG. 1 is an exploded perspective view of a portion a chair showing a chair seat, one chair arm, and female and male sections of a detachable arm mounting mechanism in accordance with a preferred embodiment employing teachings of the present invention.

Referring to FIG. 1, there is shown a bottom perspective view of part of a chair 10 including a chair seat 12 and chair arm 14 and one embodiment of a mounting and latch mechanism 18 in accordance with the present invention which permits the chair arm 14 to be selectively attached to and removed from the chair 10. In order to simplify the figures, the chair legs, the chair back, and the other chair arm 14 have not been shown. The chair seat 12 has a generally horizontal top surface 12*a* to permit a user to sit thereon and a bottom surface 12*b*. The chair arm 14 typically has a generally vertical support bar 20 and an arm rest 16 at the top 20*a* of the support bar 20. The lower end portion 20*b* of the support bar 20 extends generally horizontally and is adapted to be attached to the chair 10 in order to support the arm rest 16 in the desired position and orientation with respect to the user.

Figure 2:
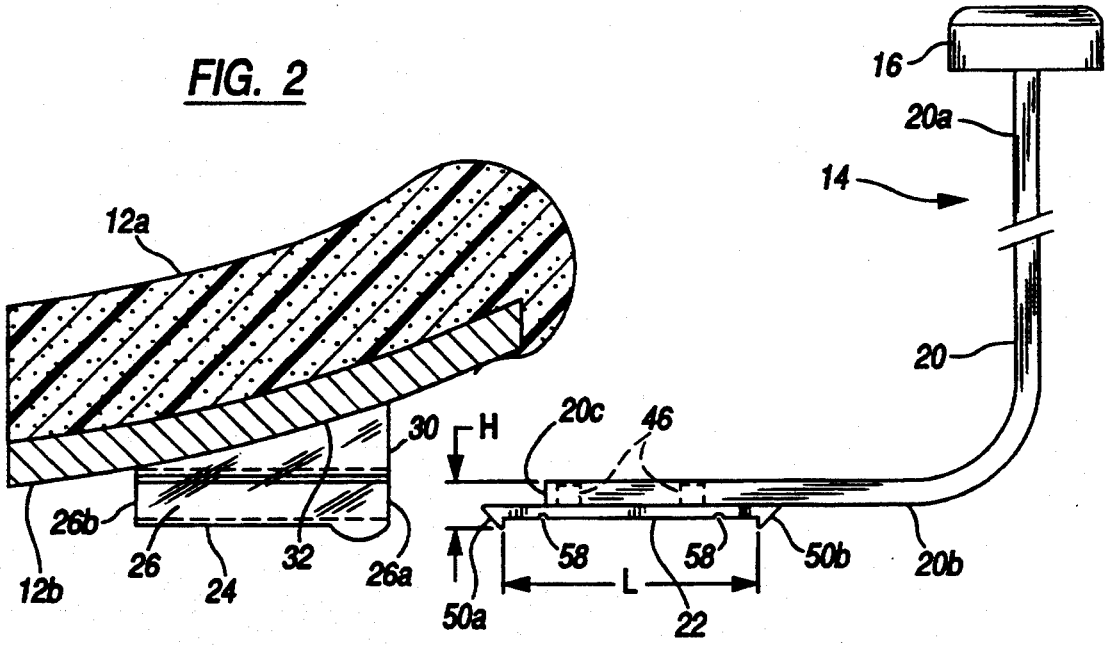
FIG. 2 is a front view of the chair seat, the chair arm and the mounting mechanism of FIG. 1 in a first, preparatory position.
Figure 5:
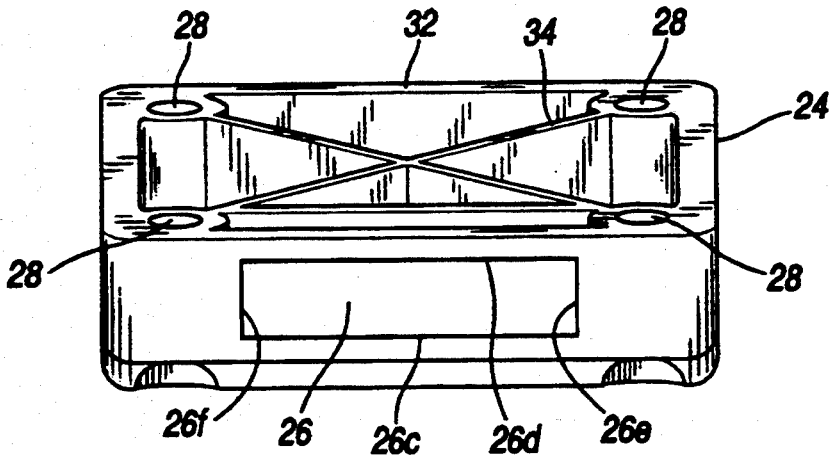
FIG. 5 is an end view of the female member as in FIG. 1, from the right end in FIG. 7.
Figure 6:
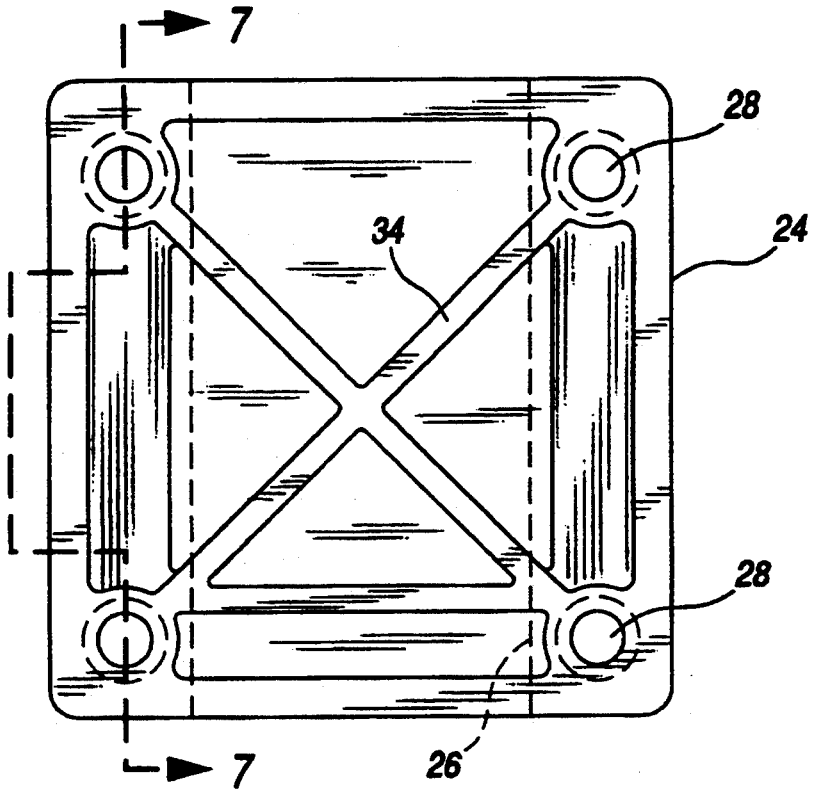
FIG. 6 is a top view of the female member of FIG. 1.
Figure 7:
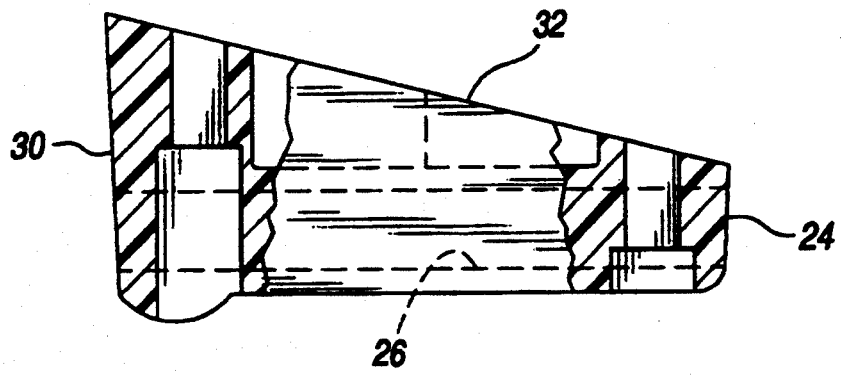
FIG. 7 is a cross-sectional view of the female member of FIG. 1 taken along line 7—7 in FIG. 6.

The latch mechanism 18 is adapted to hold the chair arm 14 and the arm rest 16 in a desired position and orientation with respect to the user. To this end, the female member 24 has a configuration which accommodates the portion of the seat support assembly to which it is affixed and to provide the slot 26 at the selected orientation. In order to accommodate the curved bottom surface 12*b* of the chair seat 12, the upper portion 30 of the female member 24 has a curved upper surface 32 adapted to maintain the slot 26, and the portion 20*b* of the chair arm 14 in a generally level orientation. Referring to FIGS. 2 and 5, the slot 26 has inlet and outlet ends 26*a*, 26*b* formed by opposing top and bottom walls 26*c*, 26*d* and opposing side walls 26*e*, 26*f*. The upper portion 30 of the female member 24 may also have a plurality of transverse reinforcing bars 34 for additional structural strength and support as best shown in FIGS. 5–6. Means for attaching the female member 24 to the chair 10 is provided. In the illustrated embodiment, the female member 24 has a plurality of holes 28 so that the female member 24 can be attached to the chair seat 12 by screws, bolts and the like. Other attaching means will be apparent to those skilled in the art.

In order to attach the chair arm 14 to the chair seat 12, the mounting and latch member 22 is adapted to be joined with the portion 20*b* of the arm support bar to form a male mounting section which is inserted into and latched to the female member 24. The member 22 has a generally flat base 36 delimited by sides 38, ends 40 and a bottom 44 and top surface 42 and of a configuration to be inserted into the slot 26. Means for attaching the member 22 and the support bar portion 20*b* of the chair arm 14 is provided to prevent relative lateral movement therebetween. In the illustrated embodiment, the attaching means comprises a plurality of protuberances 46 projecting outwardly from the top surface 42 of member 22 and which are adapted to snugly engage within a plurality of corresponding holes 48 in the chair arm 14 as shown in FIGS. 1–4. When the member 22 and the support bar 20 are attached together, it is preferred that the protuberances 46 be flush with or below the opposite surface of the assembled support bar 20 in order to minimize obstructions when the support bar 20 and the member 22 are inserted into the female member 24. Each protuberance 46 may also have a hole 46*a* for permitting a screw or the like to affix the member 22 relative to the support bar 20. Other attaching means will be apparent to those skilled in the art. The member 22 and the chair arm 14 may also be formed as a single integral piece made of metal, plastic or other suitable material. It is also preferable for a groove 46*b* to extend around the periphery of each protuberance 46 to accommodate machining flaws such as burrs, flanges and the like thereby insuring that the top surface 42 of the male member 22 will be flat along the bottom face of the support bar 20.

Figure 4:
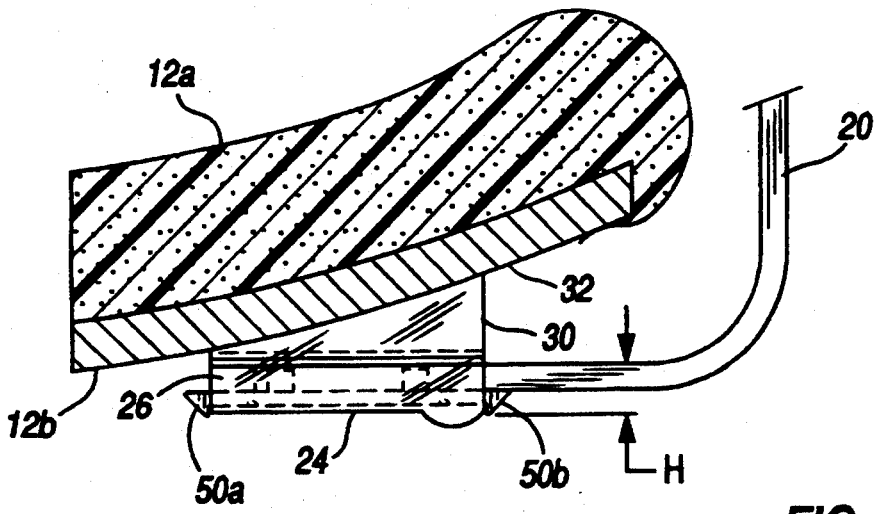
FIG. 4 is a front view of the chair seat, the chair arm and the latch in a second, assembled position for attaching the chair arm and the chair.

In order to hold the assembled member 22 and chair arm 14 in the slot 26 of the member 24 and prevent movement thereof, each end 40 of the member 22 has a toe 50*a*, 50*b* projecting outwardly from the bottom side 44 to provide a stop or latching shoulder. In the illustrated embodiment, when the member 22 and the support bar 20 are inserted into the member 24 as shown in FIG. 4, the toes 50*a*, 50*b* are adapted to receive one of the walls 26*c* of the female member 24 therebetween and hold the assembled member 22 and chair arm within the slot 26. When the trailing toe 50*b* engages the inlet end 26*a* of the slot 26 as shown in FIG. 4, the member 22 is prevented from being inserted beyond the inlet end 26*a* of the slot 24. Similarly, the leading toe 50*a* engages the outlet end 26*b* of the slot 26 as shown in FIG. 4 and prevents the withdrawal of the member 22 and the attached chair arm 14 unless the leading toe 50*a* is first disengaged from the outlet end 26*b* of the slot 26. It will also be appreciated that instead of engaging the inlet end 26*a* and the outlet end 26*b* of the slot 26, the toes 50 may releasably engage openings (not shown) which are disposed in one of the walls and located between the inlet end 26*a* and the outlet end 26*b* so that they receive one of the walls of the slot 26 therebetween and hold the member 22 and chair arm 14 in the slot 26.

It is preferred that the toes 50*a*, 50*b* be formed by a generally ramp-like outboard wall 52 to minimize any obstructions when the toe 50*a*, 50*b* is initially inserted into the slot 26 and a generally vertical inboard wall 54 to snugly hold the slot wall 26*c* between the opposing vertical walls 54. In order to provide a snug fit between the leading and trailing toes 50*a*, 50*b*, the length L between the vertical walls 54 should closely approximate the length of the slot 26.

Figure 3:
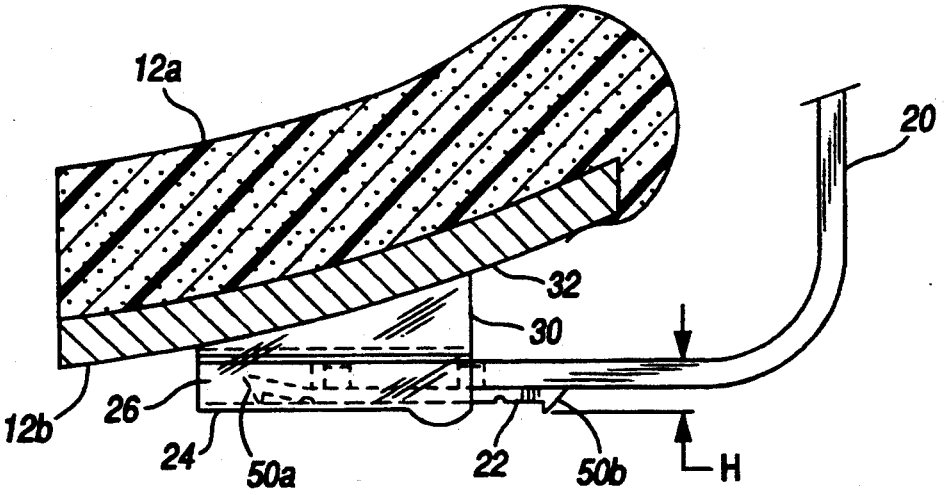
FIG. 3 is a front view of the chair seat the chair arm and the latch in an intermediate position after the initial insertion of the leading end of the male section into the female section.

In order to prevent vertical or rotational movement of the chair arm 14 the vertical thickness of the attached member 22 and support bar portion 20*b* should closely approximate the interior height of the slot 26 to provide snug engagement therebetween. Upon reference to FIGS. 2–4, it will be seen that the height H of the member 22 and the bar portion 20*b* is larger than the interior height of the slot 26. In order to permit the leading toe 50*a* to be readily inserted into and through the slot 26 and latched therein, the leading end of the male member 22 is resiliently retractable from a first position shown in FIG. 2, to an intermediate flexed retracted position shown in FIG. 3. In the first position, the leading toe 50*a* and the member 22 have not been inserted into the slot 26 so that the member 22 is in a substantially flat normal position. In the intermediate position the leading toe 50*a* is retracted and in the slot 26. The leading end of the member 22 is in a generally flexed position as shown in FIG. 3. In the assembled position shown in FIG. 4, the leading toe 50*a* has passed through the slot 26 and has resiliently returned to its normal position and thereby engages the outlet end 26*b* of the slot 26 so as to attach the chair arm 14 to the chair seat 12.

In the illustrated embodiment of FIGS. 1–10, this flexible retraction and engagement action is provided by forming the member 22 of a resiliently flexible material and including a groove 58 disposed along substantially the entire width of the male member 22 and disposed inboard of the leading toe 50*a* to form a hinge line at or outboard of the end 20C of the arm 14. The groove 58 reduces the thickness of the member 22 to focus the flexing of the member 22 disposed outboard of the groove 58 so that the leading end of the member 22 may flex in response to the force exerted thereon when the member 22 and the chair arm 14 are inserted into the slot 26. It will be appreciated that the leading end of the member 22 must extend past the leading end 20*c* of the support bar 20 for the member 22 to flex relative to the support bar 20. As shown in FIGS. 2 and 3, when the member 22 and the chair arm 14 are attached together, the leading end 20*c* of the support bar 20 is preferably disposed along the groove 58 in order to increase the flexibility of the member 22 along the groove 58. In the illustrated embodiment, the groove 58 is disposed on the bottom side 44 of the member 22 but it may also be disposed on the top side 42. The member 22 may be manufactured from any suitable material which is known to those skilled in the art as having sufficient resiliency to flex upon insertion into the slot 26 and to resiliently engage the outlet end 26*b* of the slot 26, with sheer strength to effect retention of the respective engagements.

Figure 8:
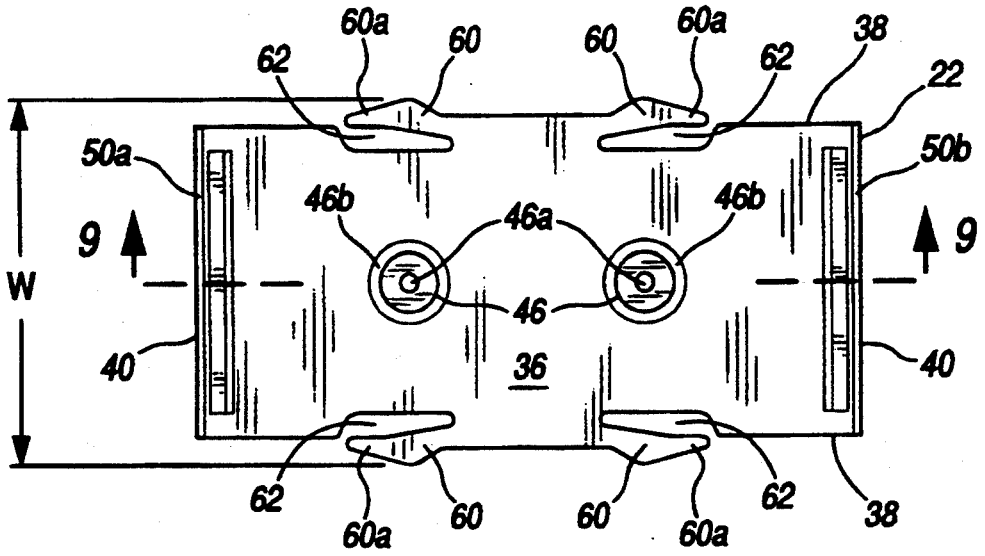
FIG. 8 is a top view of the latch member of FIG. 1.
Figure 9:
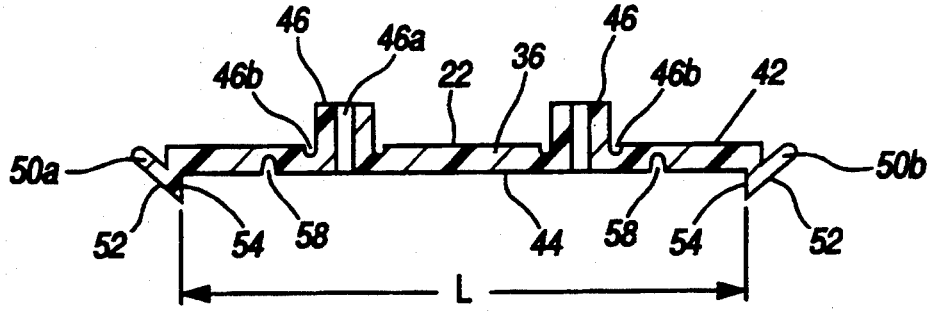
FIG. 9 is a cross-sectional view of the latch member of FIG. 1 taken along line 9—9 in FIG. 8.
Figure 10:
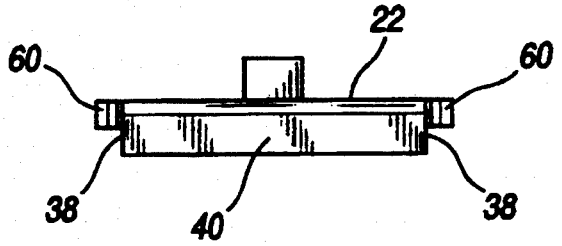
FIG. 10 is an end view of the latch member of FIG. 1.

In order to further prevent lateral or rotational movement of the chair arm, contact means is provided for assuring firm sufficient contact between the member 22 and the side walls 26*e*, 26*f* of the slot 26. The contact means comprises a plurality of resilient finger members 60 projecting outwardly from at least one side of the member 22. In order to accommodate the lateral flexing, each finger 60 preferably has a corresponding recess 62 (best illustrated in FIG. 8) disposed in the side wall 38 for receiving the inboard displacement of the finger 60. In the illustrated embodiment, the member 22 has a pair of opposing fingers 60 and recesses 62 disposed near the leading and the trailing toes 50*a*, 50*b*, but any number of fingers 60 and recesses 62 may be utilized which will provide the proper contact between the slot 26 and the male member 22. The outermost width W between the opposing fingers 60 is slightly greater than the width of the slot 26 so that when the member 22 is inserted into the member 26, the resilient fingers 60 flex inwardly toward the recesses 62 while engaging the interior walls 26*e*, 26*f* of the slot 26 and thereby provide sufficient contact therebetween. As shown in FIG. 8, it is preferable that the finger 60 have a ramp-like face 60*a* to provide a camming entry action and facilitate entry of the member 22 into the slot 26.

In order to facilitate manufacture and assembly of the member 22 and the arm support bar 20, the member 22 preferably is bilaterally symmetrical about both its lateral and longitudinal centerline axes so that either end 50*a*, 50*b* of member 22 may be the leading end which is initially inserted into the slot 26. Upon reference to FIG. 2, it will be appreciated that the toes 50*a*, 50*b* and protuberances 46 are symmetrically arrayed so that the member 22 may be attached to the bar portion 20*b* in any orientation without affecting the operation of the latch mechanism 12. Similarly, the male member 22 may be attached to either the top side or the bottom side of the support bar 20 without affecting the operation of the latch mechanism 18.

In order to attach the chair arm 14 to the chair 10, the member 24 is rigidly attached to the bottom of the chair support structure, such as on the seat 12*b* to provide a female mounting section. In the illustrated embodiment, the member 24 has a plurality of holes 28 so that the member 24 may be attached to the chair seat 12 with screws or bolts. The member 22 is attached to the lower support bar 20*b* by inserting the protuberances 46 into the corresponding holes 48 so that the leading toe 50*a* extends past the leading end 20*c* of the support bar 20 as illustrated in FIG. 2. In the preferred embodiment, the member 22 may be attached in any orientation to the support bar 20 such that either toe 50 may extend past the leading end 20*c* of the support bar 20 or the member 22 may be attached to either the top or bottom side of the support bar 20.

The assembled member 22 and support bar end portion are then inserted into the slot 26 of the member 24 until the trailing toe 50*b* engages the inlet end 26*a* of the slot 26 and prevents further insertion. In the illustrated embodiment, the leading end of the member 22 is flexed along the groove 58 and the leading end 20*c* of the support bar 20. After the trailing toe 50*b* engages the inlet end 26*a* of the slot 26, the leading toe 50*a* resiliently snaps outward and engages the outlet end 26*b* of the slot 26 so that one of the walls 26*c* of the slot 26 is releasably held between the leading and trailing toes 50*a*, 50*b*, of the member 22 as illustrated in FIG. 4. Thus, the chair arm 14 is attached to the chair seat 12.

In order to remove the chair arm 14, the user exerts a force on the leading toe 50*a* (upwardly in FIG. 4) until the leading toe 50*a* flexes upwards to disengage the outlet end 26*b* of the slot 26. The male section comprising the member 22 and the chair arm support bar portion 20*b* are then withdrawn from the slot 26.

FIGS. 1–10 thus illustrate one embodiment in which the mounting member 22 is attached to the chair arm 14 to form a male mounting section and the female member 24 attached to the chair seat 12. As illustrated in the drawings and described further below, corresponding components may be incorporated in or attached to the seat and arm in reverse fashion, with a female section on the chair arm and a mating male support section on the seat structure. For example, FIGS. 11–12 illustrate an embodiment in which the female member 124 is attached to a chair arm 14 and the mounting and latch member 122 is attached to the chair seat 12.

Figure 11:
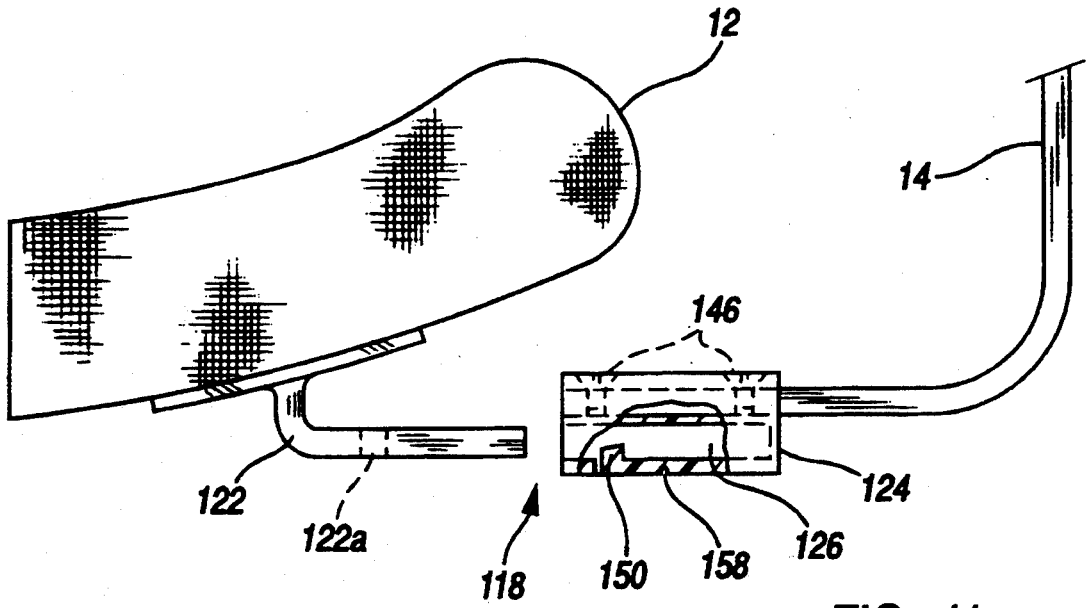
FIG. 11 is a partial front view of a chair seat, chair arm and mounting mechanism of another embodiment employing teachings of this invention, in the first, preparatory position.
Figure 12:
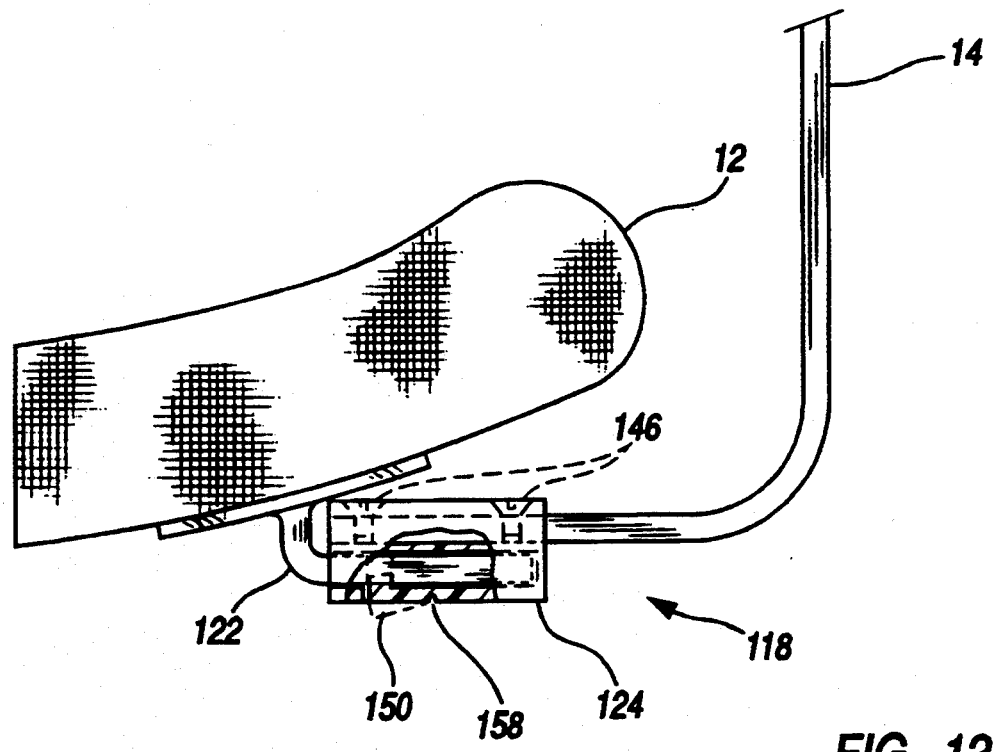
FIG. 12 is a front view of the mechanism of FIG. 11 in a second, assembled position for attaching the chair arm and the chair.

FIGS. 11–15 illustrate second and third embodiments of the mounting and latch mechanism. In contrast to the previous embodiment in which the latch was attached to the male section, at least one latch may be resiliently disposed on the female section for resilient snap-latch engagement with the male support bar section. The latch mechanism 118 illustrated in FIGS. 11–12 comprises a male member 122 attached to the chair seat 12 and a member 124 attached to the chair arm 14 by a plurality of protuberances or screws 146. The member 124 has a slot 126 forming a female section for receiving the member 122 therein. At least one toe 150 is resiliently disposed on the member 124 for resilient snap-latch engagement with the member 122. In FIGS. 11–12, the toe 150 is disposed between the ends of the slot 126 but it may also be disposed at one of the ends. In the illustrated embodiment, the toe 150 flexes downwardly along the hinge defined by groove 158 (as shown by the broken lines in FIG. 12) as the member 122 is inserted into the slot 126 and resiliently snaps into firm engagement with a shoulder 122*a* disposed on the member 122. Thus, the attached member 124 and the chair arm 14 cannot be withdrawn from the member 122 until the toe 150 is disengaged from the member 122.

Figure 13:
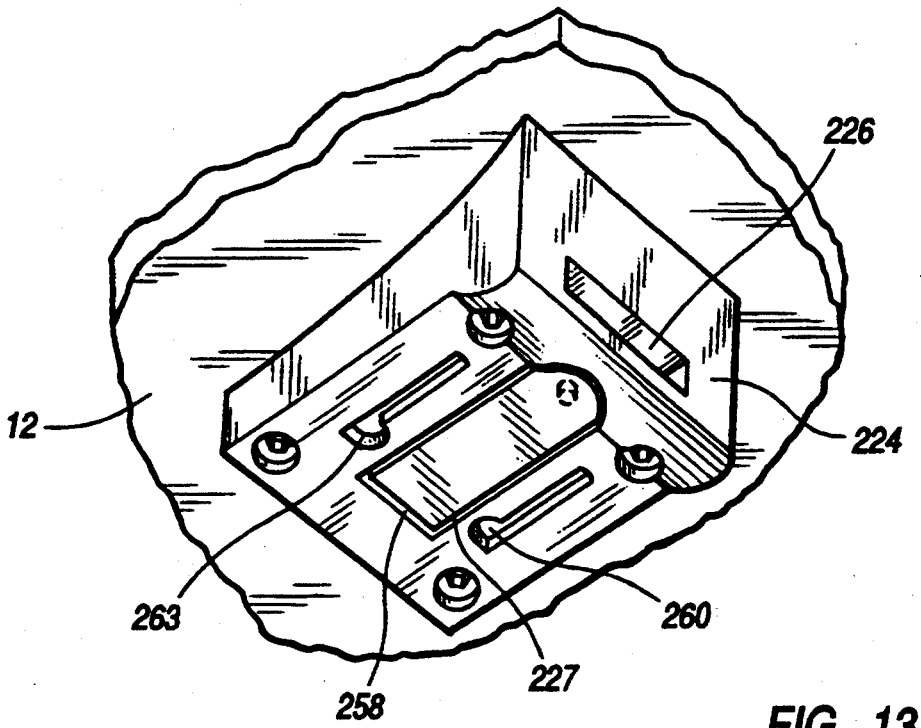
FIG. 13 is a lower perspective view of part of a third embodiment employing teachings of the invention showing a female member attached to the chair seat.
Figure 14:
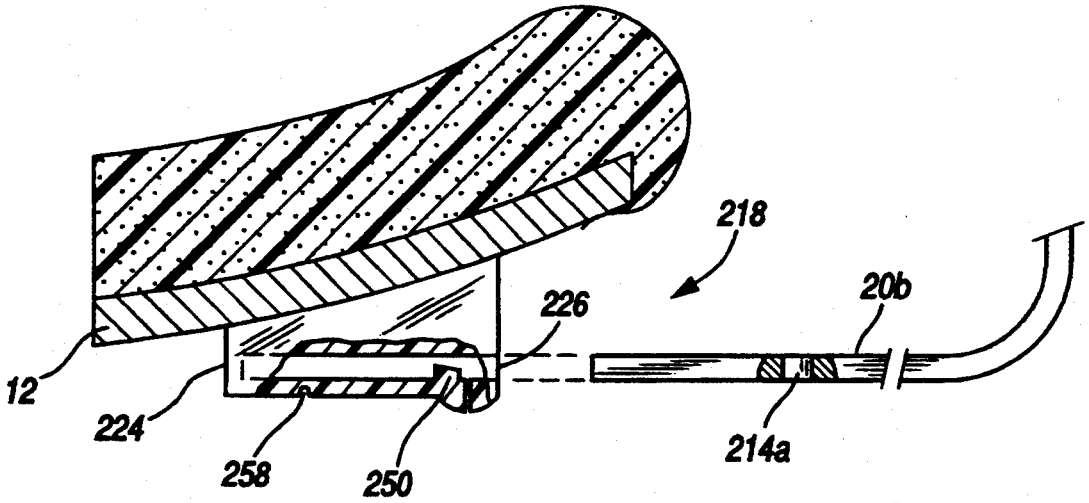
FIG. 14 is a partial front view of the chair seat, a chair arm and the latch mechanism of FIG. 13 in a first, preparatory position.

In the third embodiment illustrated in FIGS. 13–16, the mounting and latch mechanism 218 comprises a female member 224 which, like the female member 124 in the second embodiment, has a slot 226 for receiving the end portion 20*b* of the support bar therein and at least one toe 250 resiliently disposed therein for resilient snap-latch engagement with a hole 214*a* forming a shoulder disposed in the support bar. However, the female member 224 is adapted to be attached to the chair seat 12 like the female member 24 in the first embodiment. In the illustrated embodiment, the toe 250 is formed within the bottom wall of the member 224 and is adapted to flex downwardly along the hinge defined by groove 258 (as shown by the broken lines in FIG. 14) as the support bar is inserted into the slot 226 and then to resiliently snap inwardly into firm engagement with the shoulder of hole 214*a*. Thus, the chair arm cannot be withdrawn from the member 224 until the toe 250 is disengaged from the support bar portion 20*b*. The toe may be disposed between the ends of the slot 226 as shown in FIGS. 11–16 or it may be disposed at one of the ends of the slot. If the toe 250 is disposed between the ends of the slot 226 as shown in FIG. 13, it will be appreciated that there will be a corresponding cut-out opening 227 which permits the toe 250 to flex relative to the remainder of the member 224.

Figure 15:
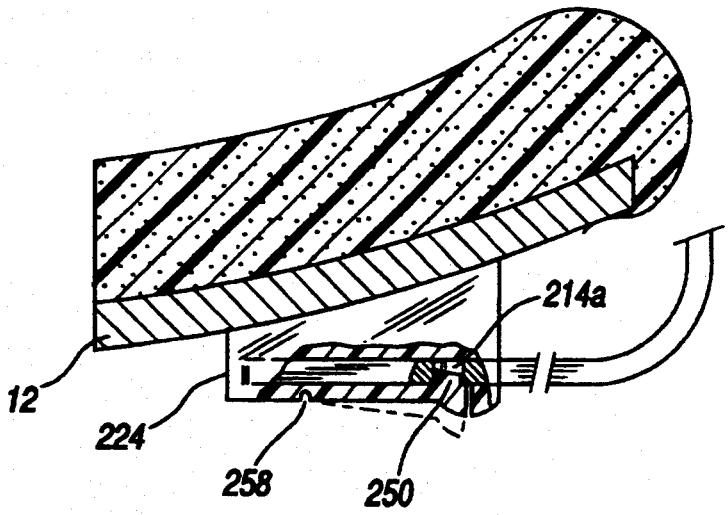
FIG. 15 is a partial front elevational view of the mechanism of FIG. 13 showing the latch in a second, assembled position for attaching the chair arm and the chair.
Figure 16:
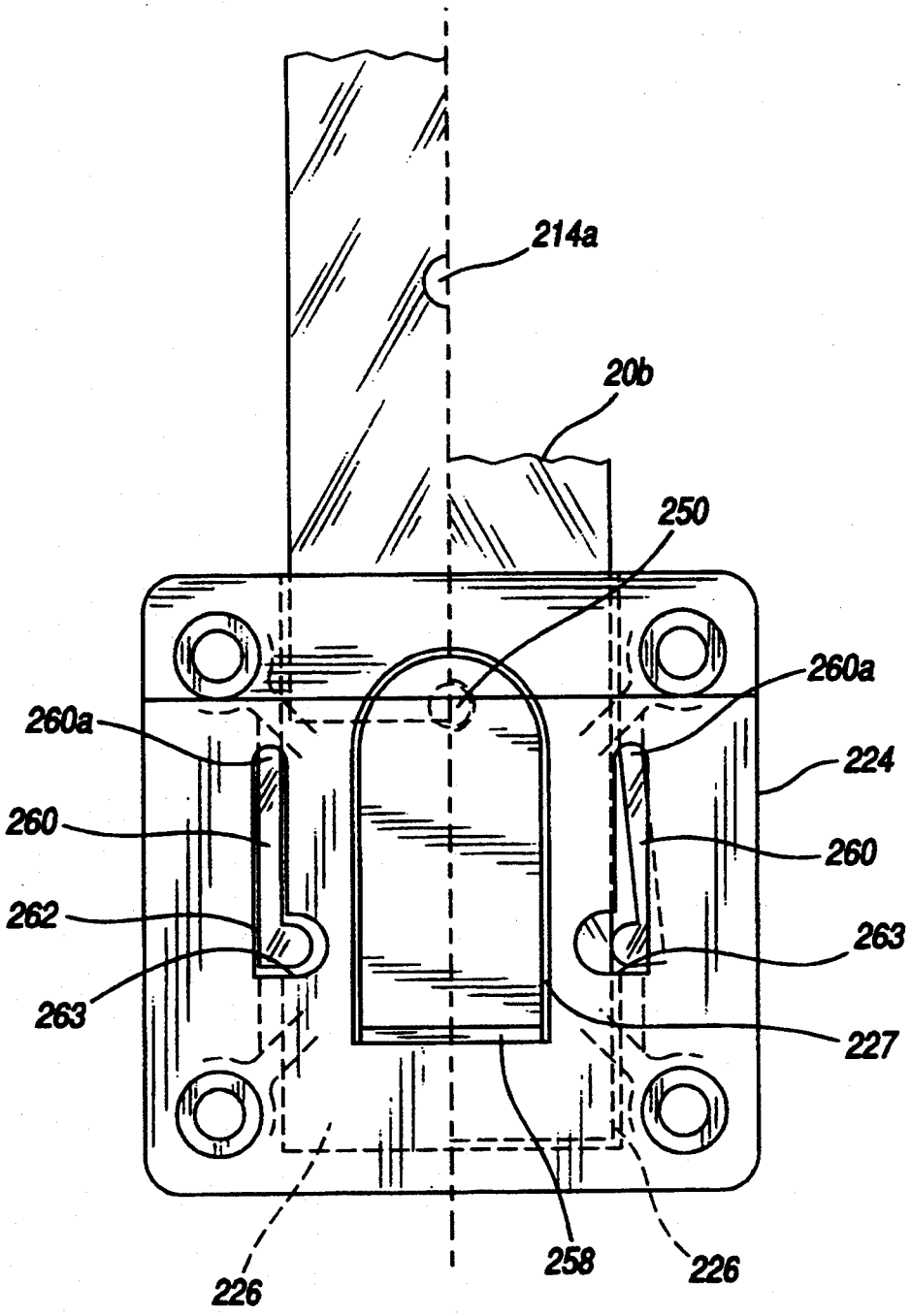
FIG. 16 is a plan view of a chair arm and the latch mechanism of FIG. 13 in a preparatory position.

In the third embodiment, the female section member 224 may also have a plurality of fingers 260 disposed along the inner side walls 226*a* of the slot 226 for lateral movement in response to the support bar portion 20*b* so as to resiliently engage the sides of the support bar 20 and provide secure lateral support between the member 226 and support bar. It will be appreciated that the member 124 of the second embodiment may have similar fingers to resiliently engage the member 122. Referring to FIGS. 13 and 15, it will be seen that the fingers 260 are resilient attached to the walls 226*a* forming the slot 226 generally depicted at 260a, that recesses 262 are defined between the respective fingers 260 and the slot walls, and apertures 263 are defined between the respective fingers 260 and the slot floor. The recesses 262 and apertures 263 permit lateral displacement of the fingers 260 in response to the support bar 14.

Thus it will be seen that chair arms and related chair structures have been provided which attain the aforenoted objects. Various additional modifications of the described embodiments of the invention specifically illustrated and described herein will be apparent to those skilled in this art, particularly in light of the teachings of this invention.

I claim as my invention:

1. A chair having a seat support structure and a removable chair arm wherein;

one of the seat support structure and the chair arm includes a male mounting section, the other of the seat support structure and the chair arm includes a female mounting section defining a socket for receiving the male mounting section therein, at least one latch which projects from one of said sections and is movable between a first position for latchably engaging the other of said sections when said male section is received in said socket so that said male section is retained in said socket, and a second position in which said latch is disengaged from said other of said sections for permitting the male section to move into and out of said socket for selectively attaching and removing said chair arm, and a second latch projects outwardly from one of said sections for engaging the other of said sections for limiting insertion of the male section into said socket of said female section.

2. A chair as in claim 1 wherein said latch comprises a toe flexibly and resiliently attached to said male section for latchably engaging a shoulder on the female section.

3. A chair as in claim 2 comprising a groove disposed in said male section defining a hinge to permit said toe to resiliently flex at said groove.

4. A chair having a seat support structure and a removable chair arm wherein:

one of the seat support structure and the chair arm includes a male mounting section, the other of the seat support structure and the chair arm includes a female mounting section defining a socket for receiving the male mounting section therein, at least one latch which projects from one of said sections and is movable between a first position for latchably engaging the other of said sections when said male section is received in said socket so that said male section is retained in said socket, and a second position in which said latch is disengaged from said other of said sections for permitting the male section to move into and out of said socket for selectively attaching and removing said chair arm, resilient contact means is disposed on one of said sections for maintaining secure lateral engagement between said sections;

said contact means comprises a plurality of resiliently biased fingers for flexing laterally in response to the other of said sections when said male section is inserted into said socket of said female section, and said contact means includes a recess corresponding to each finger for receiving the respective finger therein in response to the lateral displacement of said finger.

5. A chair as in claim 4 wherein said fingers are disposed on at least one side of one of said sections.

6. A chair as in claim 5 wherein said fingers are disposed on both sides of said one of said sections.

7. A chair having a seat support structure and a removable chair arm wherein:

one of the seat support structure and the chair arm includes a male mounting section, the other of the seat support structure and the chair arm includes a female mounting section defining a socket for receiving the male mounting section therein, at least one latch which projects from one of said sections and is movable between a first position for latchably engaging the other of said sections when said male section is received in said socket so that said male section is retained in said socket, and a second position in which said latch is disengaged from said other of said sections for permitting the male section to move into and out of said socket for selectively attaching and removing said chair arm, resilient contact means is disposed on one of said sections for maintaining secure lateral engagement between said sections, and said socket is defined by at least one wall and said contact means comprises a plurality of resiliently biased fingers disposed on said sections to engage said wall and to flex laterally in response to said wall to maintain contact between said fingers and said wall.

8. A chair having a seat support structure and a removable chair arm wherein:

one of the seat support structure and the chair arm includes a male mounting section, the other of seat support structure and the chair arm includes a female mounting section defining a socket for receiving the male mounting section therein, at least one latch which projects from one of said sections and is movable between a first position for latchably engaging the other of said sections when said male section is received in said socket so that said male section is retained in said socket, and a second position in which said latch is disengaged from said other of said sections for permitting the male section to move into and out of said socket for selectively attaching and removing said chair arm, and one of said sections includes a molded plastic mating portion which includes said movable latch.

9. A chair as in claim 8 wherein said male mounting section is joined to said seat support structure and said molded plastic mating portion is affixed to said chair arm and defines said socket.

10. A chair as in claim 8 wherein said female mounting section includes at least one inward projection affixed to a side wall of said socket for engaging a side of said male mounting section when said sections are mated, and said movable latch includes a cantilever latch in one wall of said socket.

11. A chair as in claim 10 wherein said projection includes a resilient finger projecting inward of said socket from a side wall of said socket.

12. A chair as in claim 11 wherein said molded plastic portion is affixed to said seat support structure.

13. A chair as in claim 8 wherein said molded plastic mating portion includes resilient contact means disposed thereon for maintaining secure lateral engagement between said sections.

14. A chair as in claim 13 wherein said resilient contact means comprises at least one resiliently biased element for engaging a side of the other of said sections when said sections are mated.

15. A chair as in claim 14 wherein said molded plastic mating portion is part of said male mounting section.

16. A chair as in claim 14 wherein said molded plastic mating portion is a part of said male section.

17. A chair as in claim 16 wherein said male mounting section includes a mounting arm portion disposed for mating engagement in said socket of said female mounting section, and said molded plastic mating portion is interlockable with said arm portion and forms said male mounting section therewith which is receivable in said socket with said arm portion.

18. A chair having a seat support structure and a removable chair arm wherein:

one of the seat support structure and the chair arm includes a male mounting section, the other of the seat support structure and the chair arm includes a female mounting section defining a socket for receiving the male mounting section therein, at least one latch which projects from one of said sections and is movable between a first position for latchably engaging the other of said sections when said male section is received in said socket so that said male section is retained in said socket, and a second position in which said latch is disengaged from said other of said sections for permitting the male section to move into and out of said socket for selectively attaching and removing said chair arm, and said male mounting section includes:

a mounting arm portion disposed for mating engagement in said socket of said female mounting section, and an attachment member which is interlockable with said arm portion and includes said latch projection, said arm portion and interengaged attachment member together being fittable into said socket for detachably securing said chair arm to said seat support structure.

19. A chair having a seat support structure and a removable chair arm wherein:

one of the seat support structure and the chair arm includes a male mounting section, the other of the seat support structure and the chair arm includes a female mounting section defining a socket for receiving the male mounting section therein, at least one latch which projects from one of said sections and is movable between a first position for latchably engaging the other of said sections when said male section is received in said socket so that said male section is retained in said socket, and a second position in which said latch is disengaged from said other of said sections for permitting the male section to move into and out of said socket for selectively attaching and removing said chair arm, said socket includes an abutment engaged by said male section which limits the extent of said male section into said socket and said latch engages said female section to prevent disengagement of said sections, and said latch comprises a toe flexibly and resiliently attached to said arm portion for latchedly engaging a shoulder on said female section to prevent said arm portion from being withdrawn from said socket.

20. The chair as in claim 19 wherein said shoulder is disposed at one end of said socket.

21. The chair as in claim 19 comprising a second toe disposed on said arm portion in spaced opposed relation to said first toe for engaging said female section between said toes and holding said arm portion in secure engagement with said female section.

22. The chair as in claim 21 wherein said arm portion has a leading end which is inserted into said socket and a trailing end, and said first and second toes are disposed on said leading and trailing ends respectively.

23. A chair having a seat support structure and a removable chair arm comprising:

one of the seat support structure and the chair arm including a male mounting section, the other of the seat support structure and the chair arm including a female mounting section defining a socket for receiving the male mounting section, said male mounting section including:

a mounting arm portion disposed for mating engagement in said socket of said female mounting section, and an attachment member which is interengageable with said arm portion, an interlocked assembly of said arm portion and said attachment member together being fittable into said socket and detachably interengageable with said female mounting section to secure said attachment member and arm portion in said socket for detachably securing said chair arm to said seat support structure.

24. A chair as in claim 23 and wherein said attachment member has resilient snap lock engagement with said female mounting section.

25. A chair as in claim 24 and wherein said arm portion is of substantially uniform cross-section, said attachment member and said arm portion having interfitting protrusion and recess portions to effect said interlockable relationship therebetween, and the interfit of said attachment member and said arm portion in said socket maintaining said interlocked relationship between said attachment member and said arm portion.

26. A chair as in claim 23 wherein said attachment member has firm resilient sliding engagement with the sides of said socket, thereby providing lateral stability between said mounting sections.

27. The chair as in claim 26 wherein a plurality of resiliently biased fingers are disposed on said attachment member for flexing laterally in response to said female section when said male section is inserted into said socket.

28. A chair as in claim 26 wherein said socket and said arm portion and said attachment member each is of generally rectangular cross section.

29. A chair as in claim 28 wherein said attachment member is a molded member, said arm portion having at least one recess therein, and said attachment member including at least one protrusion which extends into said recess for effecting said interlockable relationship therebetween.

30. A chair as in claim 29 wherein said chair arm includes said male mounting section and said seat support structure includes said female mounting section.

31. A chair as in claim 30 wherein said female mounting section is a molded member which is attached to said seat support structure.

* * * * *